US005418008A

United States Patent [19]

Calvert

[11] Patent Number: 5,418,008

[45] Date of Patent: May 23, 1995

[54] METHOD FOR PRODUCING BARRIER PACKAGING

[75] Inventor: Barry G. Calvert, Covington, Va.

[73] Assignee: Westvaco Corporation, New York, N.Y.

[21] Appl. No.: 309,682

[22] Filed: Sep. 21, 1994

Related U.S. Application Data

[63] Continuation-in-part of Ser. No. 185,054, Jan. 24, 1994, which is a continuation-in-part of Ser. No. 48,794, Apr. 16, 1993, abandoned.

[51] Int. Cl.[6] ..... B05D 3/06

[52] U.S. Cl. ..... 427/203; 427/208; 427/208.2; 427/210; 427/261; 427/288; 427/361; 427/385.5; 427/411

[58] Field of Search ..... 427/208.2, 210, 261, 427/288, 208, 203, 361, 385.5, 411

[56] References Cited

U.S. PATENT DOCUMENTS

| | | | |
|---|---|---|---|
| 3,788,876 | 1/1974 | Baker et al. | 117/38 |
| 3,863,832 | 2/1975 | Gordon et al. | 229/30 |
| 4,002,801 | 1/1977 | Knechtges et al. | 428/474 |
| 4,070,398 | 1/1978 | Lu | 206/524.2 |
| 4,249,978 | 2/1981 | Baker | 156/291 |
| 4,336,166 | 6/1982 | Penczuk et al. | 524/53 |
| 4,438,232 | 3/1984 | Lee | 524/272 |
| 4,469,754 | 9/1984 | Hoh et al. | 428/476.3 |
| 4,522,972 | 6/1985 | Mondt et al. | 524/548 |
| 4,861,821 | 8/1989 | Aubry et al. | 524/512 |
| 4,930,639 | 6/1990 | Rigby | 206/621 |
| 5,039,339 | 8/1991 | Phan et al. | 428/481 |
| 5,169,470 | 12/1992 | Goldberg | 156/244.14 |
| 5,183,706 | 2/1993 | Bekele | 428/349 |
| 5,217,159 | 6/1993 | Calvert et al. | 229/3.1 |
| 5,234,159 | 8/1993 | Lorence et al. | 229/25.35 |

*Primary Examiner*—Bernard Pianalto

*Attorney, Agent, or Firm*—J. R. McDaniel; R. L. Schmalz

[57] ABSTRACT

The present invention relates to a method and apparatus for producing paperboard packaging blanks (trays, lids, cartons, or combinations) in which the application of the barrier coating is combined with the printing of the sales graphics in a single-pass operation which eliminates the need for a separate off-line coating operation.

12 Claims, 3 Drawing Sheets

METHOD FOR PRODUCING BARRIER PACKAGING

CROSS-REFERENCE TO RELATED APPLICATIONS

This application is a continuation-in-part of my commonly assigned, co-pending U.S. patent application Ser. No. 08/185,054, filed Jan. 24, 1994, entitled "Heat Sealed, Ovenable Food Carton Lids" which is a continuation-in-part of my commonly assigned, U.S. patent application Ser. No. 08/048,794, filed Apr. 16, 1993, entitled "Heat Sealed, Ovenable Food Carton," now abandoned.

BACKGROUND OF THE INVENTION

1. Field of the Invention

The present invention relates to a method and apparatus for producing paperboard packaging blanks (trays, lids, cartons, or combinations) in which the application of the barrier coating is combined with the printing of the sales graphics in a single-pass operation which eliminates the need for a separate off-line coating operation.

2. Description of the Prior Art

To meet complex purity and performance specifications, highly specialized packaging systems have been developed for distributing, marketing and heating food for service and consumption. Many of these packaging systems are based upon a structural substrate folded from a pre-printed and die-cut bleached sulphate paperboard as described by U. S. Pat. No. 4,249,978 to T. R. Baker, entitled "Method Of Forming A Heat Resistant Carton", U.S. Pat. No. 3,788,876 to D. R. Baker et al., entitled "Carton Blanks Printed with a Heat Sealable Composition and Method Thereof" and commonly assigned U. S. Pat. No. 4,930,639 to W. R. Rigby, entitled "Ovenable Food Container with Removable Lid".

In the case of food packaging, to protect the paper package or carton from moisture degradation, due to direct contact with a food substance, the internal surfaces of such a carton are coated with a moisture barrier of one or more continuous films of thermoplastic resin. In other food and non-food applications paperboard is coated with barrier films which provide resistance to oxygen, fragrance or other gas molecule transmission. These films are usually applied to the paperboard web, prior to printing and cutting, as a hot, viscous, extruded curtain or as a viscous solution or emulsion using conventional coating techniques. Low density polyethylene (LDPE), polypropylene (PP) and polyethylene terephthalate (PET) are three of the extruded thermoplastic resins commonly used for this purpose. Acrylics, polyvinyl dichloride (PVDC), and PET are commonly applied using conventional viscous coating techniques.

Cartons for paperboard-based food packaging may take one of several forms including a top flap that is an integral continuation of the same paperboard sheet or "blank" from which the carton is erected, such a top flap being crease hinged to one sidewall of the carton. Another type of carton commonly used for food packaging has a lid independent of the paperboard blank from which the carton is formed. The lid for such a carton can be attached to the carton in various manners. Some of the common techniques include an attachment to the sidewalls of the carton or to peripheral flanges extending from the sidewalls of the carton.

However, cartons and lids of the foregoing description require two separate converting operations following the manufacture of the paperboard: 1) off-line coating or extrusion of the thermoplastic barrier coating; and 2) printing of the sales graphics. Consolidating these operations would offer obvious economic advantages.

Also, extrusion or off-line coating operations, presently used to produce the base substrate for the packaging described, are performed in a facility separate from the plant printing graphics. Inherent in having two separate operations is added transportation costs and waste. Both operations when performed separately require trim to be taken from both edges of the web, typically amounting to a substrate and coating material waste factor up to 15%. Consolidation of these operations and utilization of the coatings and techniques described herein cuts the waste by 50% or more and eliminates the need for additional transportation costs. The rolls are obviously handled less due to the reduction in transit; therefore, an added benefit of the processing described is a substantial decrease in inherent transit damage to the rolls.

Moreover, relatively high polymer coat weights are required for an extruded moisture barrier (typically from 11 to 26 pounds per 3000 ft.$^2$ ream) since lighter coat weights usually result in an inconsistent polymer layer thickness or a layer with little or no adhesiveness to the paperboard.

Finally an extruded polymer moisture barrier greatly complicates those recycling procedures necessary to recover the carton fiber constituency.

It is apparent from the above that there exists a need in the art for a method and apparatus which is capable of producing paperboard barrier packaging which avoids the high cost and waste associated with the prior, known methods and apparatus for producing barrier packaging.

SUMMARY OF THE INVENTION

Generally speaking, this invention fulfills these needs by providing a single-pass method for preparing a paperboard web having a calendered coating of particulate minerals located substantially on a first side of the paperboard web, comprising the steps of: printing sales graphics substantially over the calendered coating on the first side of the paperboard web; and coating a second side of the paperboard web with an emulsion which provides barrier and heat seal properties wherein all steps are accomplished in a single-pass converting process.

In certain preferred embodiments, the water-based emulsion or solvent solution is applied to the second side of the paperboard web, that has not been previously coated with a particulate mineral coating, with a dry coat weight of 3 to 12 pounds per 3000 ft$^2$. When the second side is coated with a calendered coating of particulate minerals the water-based emulsion coat weight is applied at 1 to 10 pounds per 3000 ft$^2$ over the particulate coating. Coating weight is dependent upon the package end use. Generally scored cartons would require higher coat weights than a separate lid.

In another further preferred embodiment, the method and apparatus for producing barrier packaging creates a paperboard food distribution vessel and lid which can be heat sealed and ovenable while avoiding high costs and waste.

BRIEF DESCRIPTION OF THE DRAWINGS

The above and other features of the present invention, which will become more apparent as the description proceeds, are best understood by considering the following detailed description in conjunction with the accompanying drawings, wherein like characters represent like parts throughout the several views and in which.

DETAILED DESCRIPTION OF THE INVENTION

A paperboard substrate of the present invention is, typically, constructed from a 0.018 inch thick bleached sulphate sheet, solid unbleached sulfate (SUS) or clay coated newsback (CCNB). Definitively, the term paperboard describes paper within the thickness range of 0.008 to 0.028 inches. The invention is relevant to the full scope of such a range, as applied to packaging and beyond.

When used for food carton stock, paperboard is usually clay coated on at least one side surface and occasionally on both sides. The paperboard trade characterizes a paperboard web or sheet that has been clay coated on one side as C1S and C2S for a sheet coated on both sides. Compositionally, the paperboard coating is a fluidized blend of minerals such as coating clay, calcium carbonate, and/or titanium dioxide with starch or adhesive which is smoothly applied to the traveling web surface. Successive densification and polishing by calendering finishes the mineral coated surface to a high degree of smoothness and a superior graphics print surface.

When C1S paperboard is used for food packaging, the clay coated surface is prepared as the outside surface, i.e., the surface not in contact with the food. Pursuant to the present invention, the other side (the side in contact with the food) is coated with a specialized, water-based emulsion to be further described in greater detail. The emulsion coating process may include means such as a gravure roll, flexocoater, a rod coater, air knife or blade.

A typical emulsion application rate, for an independent (not connected to the tray or vessel rim flange), C1S paperboard lid that is to be heat sealed to a food carton vessel rim flange is in the range of 3 to 9 dry pounds per 3000 ft.$^2$ ream. A C2S food carton lid would require only 1 to 4 dry pounds per 3000 ft.$^2$ ream due to the greater "hold out" of the emulsion moisture barrier coating inherent in a calendered, clay coated paper surface.

A typical emulsion application rate, for an independent tray and/or a tray with a hinged lid manufactured using a C1S paperboard is in the range of 6 to 12 dry pounds per 3000 ft$^2$ ream. A C2S food carton lid would require only 4 to 10 pounds per 3000 ft$^2$ ream due to greater "hold out" of the water-based emulsion barrier coating inherent in a calendered, clay coated paper surface.

Figure 1:
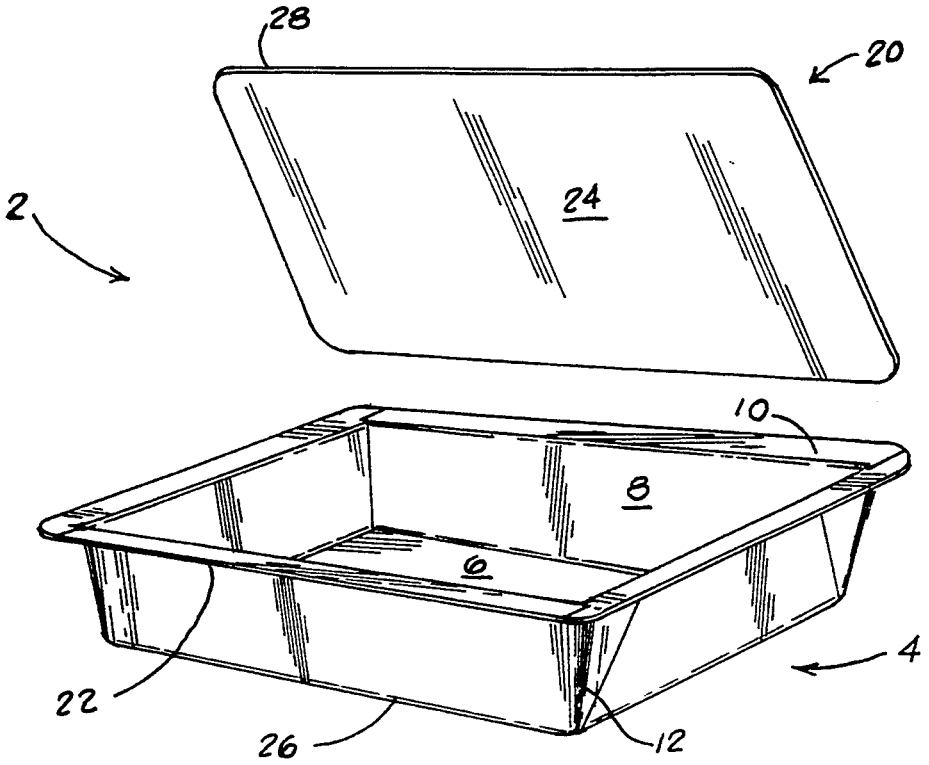
FIG. 1 is a pictorial view of a paperboard food carton having a separate lid closure, according to the present invention.

One embodiment of the present invention anticipates a construction of carton 2 similar to that of FIG. 1 which broadly comprises a vessel 4 and a closure 20. The vessel components include the bottom panel 6, side walls 8, flange 10, and corner gussets 12. The closure component 20 is separate.

Figure 6:
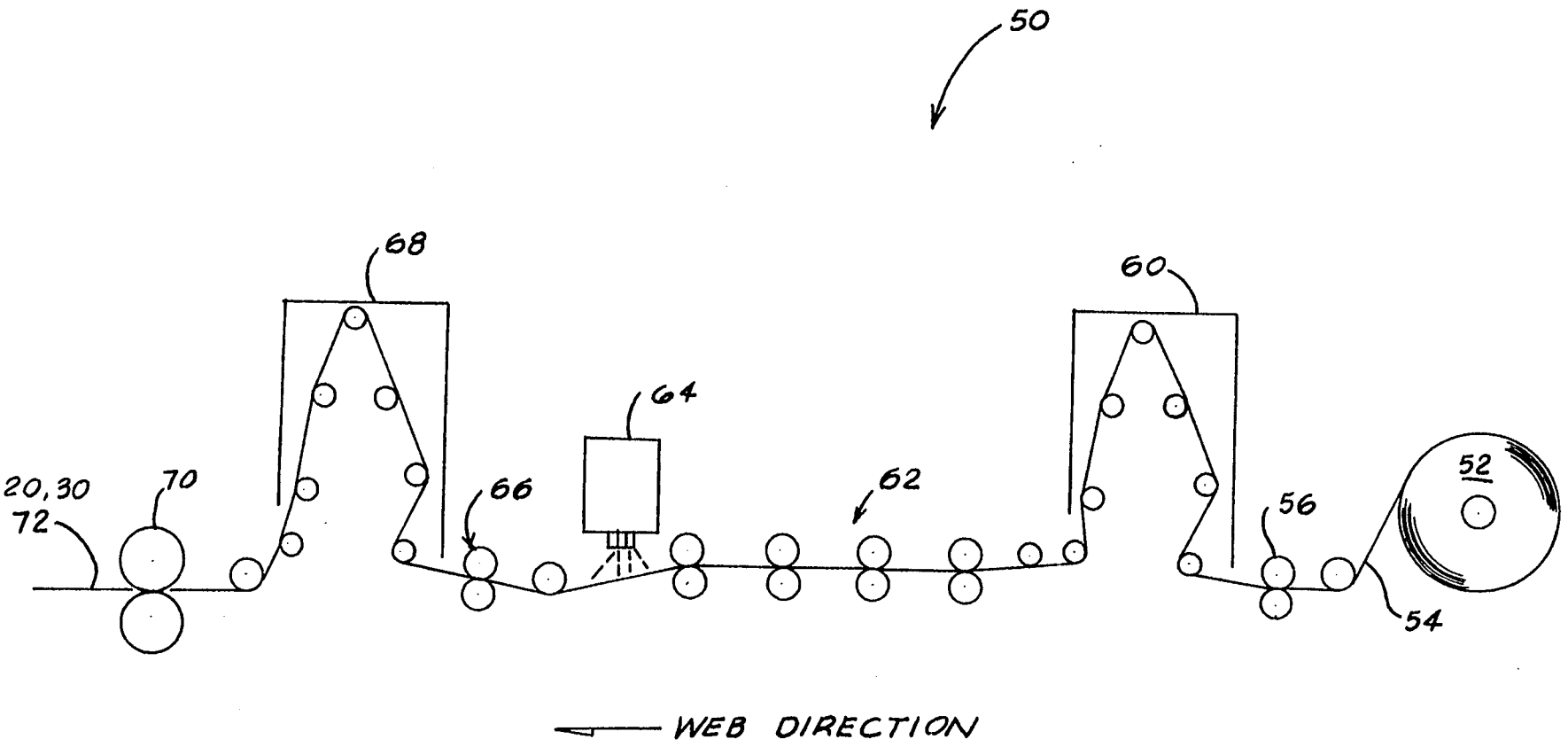
FIG. 6 is a schematic illustration of an apparatus for producing a heat sealed, ovenable food carton lid.

The flat closure or lid 20 in FIG. 1 is cut from a paperboard sheet or web 52 (FIG. 6) of great length. From a reel material handling system, in the case of a C1S paperboard web, a water-based emulsion 24 is continuously or patterned applied by means of the conventional coating techniques mentioned earlier to the non-clay side of the web at a deposition rate of, preferably, 3 to 9 dry pounds per ream. When a C2S paperboard is used the coating 24 is applied to one of the clay coated surfaces at, preferably, 1 to 4 dry pounds per ream. Related to FIG. 1, the emulsion coated side 24 of the lid would be the side opposing the internal vessel surface. Also, from a reel handling system, the clay coated surface (shown as 26 on vessel 4 and 28 on lid 20, respectively) of the web is printed with sales and informational graphics at station 62 (FIG. 6).

The tray 4 in FIG. 1 is cut from a paperboard sheet or web (FIG. 6) of great a length. From a reel material handling system, in the case of a C1S paperboard web, a water-based emulsion is continuously or patterned applied by means of the coating technique mentioned earlier to the non-clay side of the web at a deposition rate of, preferably, 6 to 12 dry pounds per ream. When a C2S paperboard is used the coating is applied to one of the clay coated surfaces, preferably, at 4 to 10 dry pounds per ream. With respect to FIG. 1, the emulsion coated side would be the internal vessel surface.

In the normal course of events, printed lid and tray blanks, as depicted in FIG. 1 being continuously cut from the sheet or web, are delivered to a food processor as stacks of independent articles. The paperboard vessel 4 is filled with food product prior to lid 20 application and sealing. Lids 20 are typically heat sealed to the tray flanges 10 by utilizing a heated platen, hot air or microwave energy sealing system. Such systems are manufactured by Kliklok Corp, of Atlanta Ga., Raque Food Systems of Louisville, Ky., and Sprinter Systems of Halmstad, Sweden.

Obvious alternative permutations of the FIG. 1 carton embodiment would be a pressed formed tray, molded pulp tray, solid plastic tray or a folded tray with a press-applied or extruded barrier.

Figure 2:
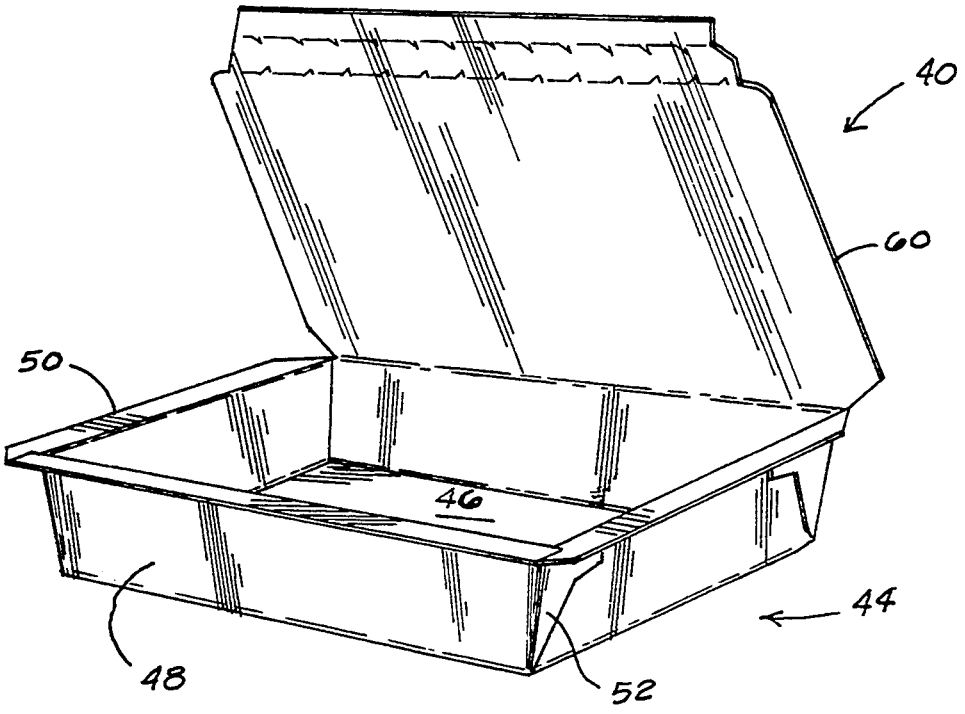
FIG. 2 is a pictorial view of a paperboard food carton having a integral lid closure, according to the present invention.

A second embodiment of the present invention is a carton 40 as shown in FIG. 2 which broadly comprises a vessel 44 with an integral closure means 60. The carton 40 components include bottom panel 46, side walls 48, flange 50, corner gussets 52, and the integral closure component 60.

The tray/lid in FIG. 2 is cut from a paperboard sheet or web (FIG. 6) of a great length. From a reel material handling system, in the case of a C1S paperboard web, a water-based emulsion is continuously or patterned applied by means of the conventional coating technique mentioned earlier to the non-clay side of the web at a deposition rate of, preferably, 6 to 12 dry pounds per ream. When a C2S paperboard is used the coating is applied to one of the clay coated surfaces, preferably, at 4 to 10 dry pounds per ream. With respect to FIG. 2, the emulsion coated side would be the internal vessel surface.

Obvious alternative permutations of the FIG. 2 carton embodiment would be a tray with gussets not attached to the side walls or a tray designed without flanges where the lid would attach to the tray sidewalls or bottom.

Figure 3:
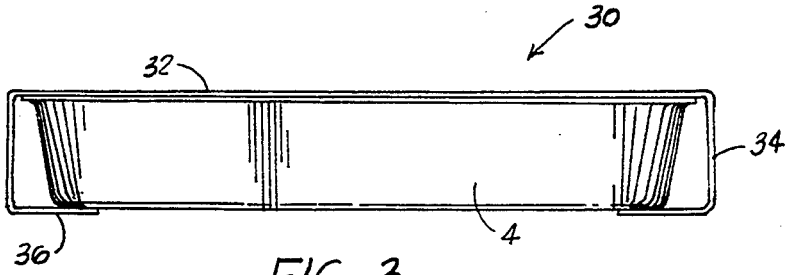
FIG. 3 is a pictorial view of a press-formed paperboard food carton having a separate lid closure, according to the present invention.
Figure 4:
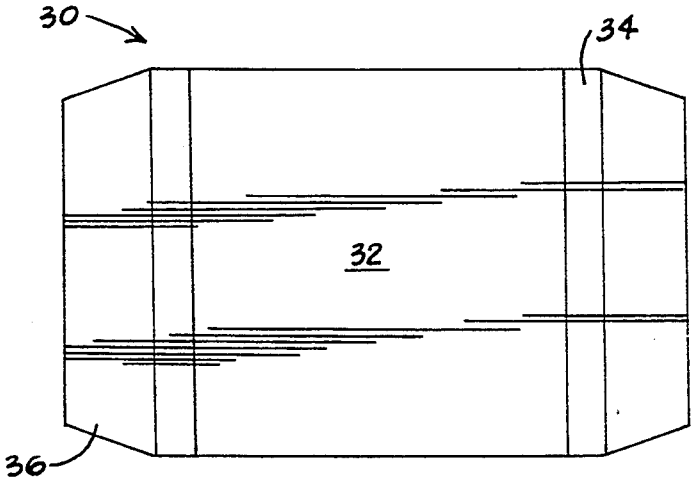
FIG. 4 is a pictorial view of a modified lid for the vessel portion in FIG. 2, according to the present invention.

In a third embodiment of the invention, illustrated by FIGS. 3 and 4, the opening of vessel 4 is sealed by an independent cover 30. The container/lid assembly is described in U.S. Pat. No. 5,090,615 to B. D. Hopkins et al., entitled "Container/Lid Assembly" and U. S. Pat. No. 5,234,159 to M. W. Lorence et al., entitled "Container/Lid Assembly". A typical tray style utilized with this lid would be manufactured from pressed paperboard coated on one or both sides with a polymer; however, the alternative tray styles previously mentioned would be applicable. The vessel 4 components include the bottom panel, side walls and flanges similar to that as shown in FIG. 1. The closure 30 components include the top panel 32, side panels 34, and bottom flaps 36. The flat lid blank in FIG. 4 would be manufactured as previously described for FIG. 1; however, the coating may be patterned out of the flap areas, if desired. The lid or closure 30 would be delivered to the food processor as part of stacks of independent articles.

After construction, the pressed paperboard vessel 4 is filled with food product prior to lid 30 application and sealing. Once the lid 30 is heat sealed to the vessel flanges, the flaps 36 are folded and sealed to the tray bottom as represented in FIG. 3.

One representative source of the water-based emulsion coating, relied upon by the present invention, includes the MW10 product of Michelman, Inc., 9080 Shell Road, Cincinnati, Ohio. Another such source is the CARBOSET XPD-1103 product of B. F. Goodrich Company, 9911 Brecksville Road, Brecksville, Ohio.

The Michelman MW 10 product comprises an acrylic copolymer resin and high density polyethylene wax. The Goodrich CARBOSET XPD-1103 product is described as an anionic emulsion of an acrylic ester copolymer in water. CARBOSET XPD-1103 is also characterized as a styrene-acrylic copolymer emulsion containing heat activated curing mechanisms stimulated by a 250°–300° F. curing temperature.

Essential properties to both of these water-based emulsions when used for food contact coatings are: (a) mass stability at temperatures below 400° F., i.e., below 400° F., the coating will not melt, degrade or otherwise lose mass (for instance, by solvent outgassing) and (b) chloroform-soluble extractives levels do not exceed 0.5 $mg/in^2$ of food contact surface when exposed to a solvent, for example, N-Heptane at 150° F. for two hours. These properties are important because they assure that the coating will not contaminate the food in contact with the coating during storage and use of the food carton.

Figure 5:
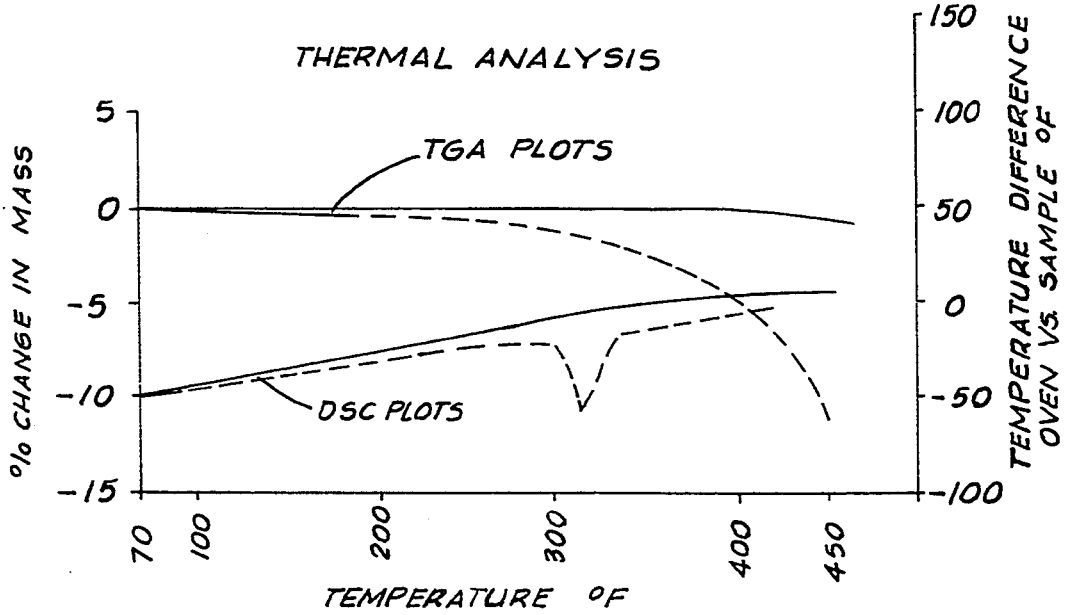
FIG. 5 is a graphical illustration of a thermal analysis of percent changes in mass versus temperature (in ° F.) versus temperature differences between the oven and the sample (in ° F.)

Representative mass stability of the Michelman MW-10 product is described in FIG. 5. The Differential Scanning Calorimetry (DSC) plot is a measure of the difference in temperature between the coating sample in an oven plotted against temperature as it is increased from ambient to 400° F.+. Any endothermic or exothermic event along the plot would represent a physical transition (i.e. melting). The solid line represents a coating with the necessary thermal properties for ovenable applications. The dotted line is typical of a coating which could not be considered for these applications because it melted at approximately 325° F.

The Thermal Gravimetric Analysis (TGA) plot, also shown in FIG. 5, is a measure of the weight of the coating sample plotted against temperature. Any significant weight loss, as indicated by the dotted TGA plot, indicates product outgassing. The solid TGA plot is representative of an acceptable coating for the use described. The dotted TGA plot is representative of an unacceptable coating due to significant weight loss at temperatures less than 400° F.

As mentioned above, another essential property of the described coated material, which in most cases directly or incidentally contacts the food, is that the materials used do not transfer to the food product during storage or reconstitution. Food substances generally packaged in the cartons described can contain high levels of fats, oils, and sugars. These substances can readily solubilize a coating, given certain conditions, which in turn could be absorbed by the food product.

To assure non-transfer of substances from the package to the food product, an extraction test on the food contact surface may be employed. Coated paperboard may be tested by use of the extraction cell described in "Official Methods of Analysis of the Association of Official Analytical Chemists, " 13th Ed. (1980) sections 21.010–21.015, under "Exposing Flexible Barrier Materials for Extraction." A suitable food simulating solvent for lid applications described would be N-Heptane. The N-Heptane should be a reagent grade, freshly redistilled before use, using only material boiling at 208° F.

The extraction methodology consists of, first, cutting the lid sample to be extracted to a size compatible with the clamping device chosen. Next, the sample to be extracted is placed in the device so that the solvent only contacts the food contact surface. The solvent is then added to the sample holder and placed in an oven for two hours at 150° F.

At the end of the exposure period, the test cell is removed from the oven and the solvent is poured into a clean Pyrex® flask or beaker being sure to rinse the test cell with a small quantity of clean solvent. The food-simulating solvent is evaporated to about 100 millimeters in the container, and transferred to a clean, tared evaporating dish. The flask is washed three times with small portions of the Heptane solvent and the solvent is evaporated to a few millimeters on a hot plate. The last few millimeters should be evaporated in an oven maintained at a temperature of approximately 221° F. The evaporating dish is cooled in a desiccator for 30 minutes.

A chloroform extraction is then performed by adding 50 milliliters of reagent grade chloroform to the residue. The mix is then warmed, then filtered through a Whatman No. 41 filter paper in a Pyrex® funnel and the filtrate is collected in a clean, tared evaporating dish. The chloroform extraction is then repeated by washing the filter paper with a second portion of chloroform. This filtrate is added to the original filtrate and the total is evaporated down to a few millimeters on a low temperature hot plate. The last few millimeters should be evaporated in an oven maintained at approximately 221° F. The evaporating dish is cooled in a desiccator for 30 minutes and weighed to the nearest 0.1 milligram to get the chloroform-soluble extractives residue.

Table 1 below indicates typical values obtained using this procedure for a water-based copolymer coating having the necessary attributes for the application described herein.

TABLE 1

| Solvent | Time/Temp | Residue (mg/in$^2$) |
|---|---|---|
| N-Heptane | 2 hrs/150° F. | .33 |
| | | .45 |
| | | .27 |
| | | .28 |
| | | .22 |
| | | .24 |

To be assured that there is no appreciable coating transfer to the food product, the chloroform-soluble extractives should not exceed 0.5 mg/in$^2$.

Other properties of the water-based emulsion of the present invention are that it is heat sealable to itself, to clay coated board and to other polymers such as polyester and polypropylene.

Representative heat sealability performance of the Michelman MW-10 product is described in Table 2 below. Samples used for the testing in Table 2 include a press applied coating printed upon a sulphate paperboard that was clay coated on both sides. The cooperative PET samples, to which the present water-based acrylic emulsion is fused, carried a 21 lbs/3000 ft.$^2$ ream hot extrusion coating of PET. Cooperative experimental conditions included a constant 60 psi clamping pressure at 350° F. temperature. The dwell time under the clamp was varied from 0.25 seconds to 2.0 seconds. "MW10" refers to the Michelman MW 10 acrylic emulsion product applied to the 0.018 in. caliper, clay coated paperboard test sample at the rate of 3 lbs/3000 ft.$^2$ ream.

TABLE 2

| Dwell Time (sec) | .25 | .40 | .50 | .75 | 1.00 | 1.25 | 1.50 | 1.75 | 2.00 |
|---|---|---|---|---|---|---|---|---|---|
| PET/PET | — | — | — | 0% | 10% | 50% | 100% | 100% | 100% |
| PET/MW10 | 0% | 10% | 100% | 100% | — | — | — | — | — |
| MW10/MW10 | 0% | 85% | 100% | 100% | — | — | — | — | — |
| PET/Clay | 0% | — | 0% | 0% | 0% | 100% | 100% | — | — |
| MW10/Clay | 0% | — | 0% | 0% | 100% | 100% | 100% | — | — |

Table 2 clearly indicates the heat sealability advantage of this coating in that sealing dwell time can be significantly reduced by having a lid coated with the water-based acrylic of the present invention (0.50 sec) versus a PET lid (1.50 sec.). This reduction in dwell time can significantly increase line speed, sealing efficiency and reduce energy costs.

Those of ordinary skill in the art will recognize the utility value of the present invention for packaging food to be heated, in the original distribution carton, within a traditional convection oven. Alternatively, the food may also be heated in a microwave oven, if desired.

Although the preferred embodiments of the present invention emphasize the unique functional and economic advantages associated with a specialized heat sealable/ovenable coating, it should be recognized that the press-applied, water-based emulsion of the present invention is also functional as an effective moisture barrier necessary in the applications described herein.

Also, while a water-based emulsion has been described, a suitable solvent-based solution could be used as long as the solvent-based solution exhibits substantially the same properties required of the water-based emulsion.

As discussed earlier in some detail, FIG. 6 illustrates a self-contained, single-pass apparatus for producing paperboard packaging blanks in which the application of the barrier and/or heat seal coating is combined with the printing of the sales graphics eliminating the need for a separate off-line coating operation. This illustration depicts production of paperboard lids 20 and 30. In particular, apparatus 50 includes, in part, paper roll 52, paper roll web 54, coating apparatus 56, conventional coating dryer 60, printing station 62, curing station 64, coating station 66, conventional coating dryer 68, conventional cutters 70, and lids 20 and 30. It should be understood that vessels 4 and 44 can also be constructed using apparatus 50.

During the operation of apparatus 50, paper roll 52 is unrolled such that web 54 is formed. Web 54 is traversed along apparatus 50 by conventional techniques to coating station 56.

At coating station 56, web 54 is coated with the water-based emulsion on the non-clay coated surface when using a C1S paperboard substrate or a clay coated surface when a C2S substrate is used.

Following the application of the water-based emulsion upon web 54, web 54 is traversed to conventional coating dryer 60 where the emulsion is dried according to conventional drying techniques. Following each drying unit, the web is cooled through contact with conventional drum chillers (not shown).

Web 54 is traversed to graphic printing stations 62 where graphics such as sales or the like are placed upon web 54 on the side opposite the water-based emulsion. Inks are then cured by curing station 64. Radiation curable inks are preferred due to their graphic appeal, endurance, and end use performance.

At coating station 66 additional coating of the same type may be applied or other functional coatings to optimize the product may be used. An example would be a coating to optimize the coefficient of friction to aid in stacking and delivery of the finished blank. Coating station 66 can be bypassed if no additional "overcoat" is deemed necessary.

FIG. 6 is only a suggested sequence as related to the application of the coating and the printing of graphics. However, in all cases both processes are accomplished in the same basic operation on a single "pass."

Following printing of graphics and application of coating to the back side of web is traversed to a cutting mechanism 70 which scores and cuts the web into the desired tray and/or lid. Rotary cutting systems have proven to be the preferred method however, other conventional cutting techniques may be employed. Additionally, one may choose to wind the web in roll form or sheet the web for cutting at a later time.

While the above discussion has focused on food packaging applications, it is to be understood that the present invention could also be applicable to other paperboard packaging where barrier properties and/or heat seal properties are needed where such properties are normally provided by extrusion or other conventional coating techniques separate from the printing operation.

Once given the above disclosure, many features, modifications or improvements will become apparent to the skilled artisan. Such features, modifications or improvements are, therefore, considered to be a part of this invention, the scope of which to be determined by the following claims.

What is claimed is:

1. A single-pass method for preparing a paperboard web having a calendered coating of particulate minerals located substantially on a first side of said paperboard web, comprising the steps of:

printing sales graphics substantially over said calendered coating on said first side of said paperboard web; and coating a second side of said paperboard web with an emulsion which provides barrier and heat seal properties wherein all steps are accomplished in a single-pass converting process.

2. The method, as in claim 1, wherein said method is further comprised of the step of:

forming said paperboard web into a paperboard blank such that said forming step is accomplished during said single-pass converting process.

3. The method, as in claim 1, wherein said emulsion is applied to said second side with a coat weight of 6 to 12 dry pounds per 3,000 $ft^2$.

4. The method, as in claim 1, including said paperboard web having said calendered coating of particulate minerals located substantially on said first side and a second side of said paperboard web wherein said method is further comprised of the step of:

coating said second side of said paperboard web with a 4 to 10 dry pounds per 3000 $ft.^2$ coating of said emulsion such that said emulsion is substantially located adjacent to said coating of particulate minerals.

5. The method, as in claim 1, wherein said method is further comprised of the step of:

drying said printed graphics and said emulsion.

6. The method, as in claim 1, wherein said emulsion is mass stable below 400° F., can be tacked bonded at 250° F. or greater and has chloroform-soluble extractives not exceeding 0.5 $mg/in^2$ of a food contact surface.

7. A single-pass method for preparing a paperboard web having a calendered coating of particulate minerals located substantially on a first side of said paperboard web, comprising the steps of:

printing sales graphics substantially over said calendered coating on said first side of said paperboard web; and coating a second side of said paperboard web with a solution which provides barrier and heat seal properties wherein all steps are accomplished in a single-pass converting process.

8. The method, as in claim 7, wherein said method is further comprised of the step of:

forming said paperboard web into a paperboard blank such that said forming step is accomplished during said single-pass converting process.

9. The method, as in claim 7, wherein said solution is applied to said second side with a coat weight of 6 to 12 dry pounds per 3,000 $ft^2$.

10. The method, as in claim 7, including said paperboard web having said calendered coating of particulate minerals located substantially on said first side and a second side of said paperboard web wherein said method is further comprised of the step of:

coating said second side of said paperboard web with a 4 to 10 dry pounds per 3000 $ft.^2$ coating of said solution such that said solution is substantially located adjacent to said coating of particulate minerals.

11. The method, as in claim 7, wherein said method is further comprised of the step of:

drying said printed graphics and said solution.

12. The method, as in claim 7, wherein said solution is mass stable below 400° F., can be tacked bonded at 250° F. or greater and has chloroform-soluble extractives not exceeding 0.5 $mg/in^2$ of a food contact surface.

* * * * *